United States Patent [19]

Pinckaers

[11] 4,099,906

[45] Jul. 11, 1978

[54] HOT SURFACE FUEL IGNITION SYSTEM

[75] Inventor: B. Hubert Pinckaers, Edina, Minn.

[73] Assignee: Honeywell Inc., Minneapolis, Minn.

[21] Appl. No.: 752,381

[22] Filed: Dec. 20, 1976

[51] Int. Cl.[2] ..... F23H 5/14

[52] U.S. Cl. ..... 431/66; 361/264

[58] Field of Search ..... 431/66, 67, 72; 361/264, 265, 266

[56] References Cited

U.S. PATENT DOCUMENTS 3,502,419 3/1970 Perl ..... 431/66

3,551,083 12/1970 Michaels ..... 431/66

3,871,814 3/1975 Das et al. ..... 431/66

*Primary Examiner*—Edward G. Favors

*Attorney, Agent, or Firm*—Alfred N. Feldman

[57] ABSTRACT

A special regulating type of transformer is used to energize a hot surface igniter, a fuel valve and a fuse in a series circuit. The design of the regulating transformer is such as to provide an operating current in the igniter and valve that will not blow the fuse as long as the igniter is neither short-circuited, nor heated to a level which would be destructive.

10 Claims, 4 Drawing Figures

HOT SURFACE FUEL IGNITION SYSTEM

BACKGROUND OF THE INVENTION

Fuel ignition systems, particularly fuel ignition systems in which hot surface igniters such as silicon carbide igniters are used, are becoming common as an energy saving measure. In many fuel burning systems in the past, a standing pilot which continuously consumed fuel was normally available as the ignition means for the main burner in the system. Since the advent of the fuel energy shortage, many ways have been considered to eliminate unnecessary consumption of fuel. The standing pilot, while very useful in some applications and areas of the country, is wasteful in other applications and areas of the country. As a result of this, efforts are being made to eliminate the standing pilot in as many applications as possible.

Various types of replacements for the standing pilot have been suggested and vary from interrupted spark ignition type devices of an electronic nature to hot surface fuel igniters, such as glow wires or other resistance type elements which become incandescent when electric current is passed through them. In prior art hot surface igniters of the negative temperature coefficient type, one type of failure that can be undesirable is an inadvertent short circuiting of the element itself. This then appears to be an igniter which is functioning properly and some means must be provided to detect this type of unsafe failure. A second type of failure that can be disastrous to a negative temperature coefficient type of hot surface igniter is driving the igniter to a temperature high enough to become destructive to the igniter itself. In this case again, the resistance of the igniter element drops to a very low value and is difficult to separate from an element which is either partially or wholly short circuited by some other type of failure.

Prior art devices have recognized that negative temperature coefficient hot surface igniters such as silicon carbide igniters, can be operated directly in series with a fuel flow control valve. When a source of electric power is applied to this configuration the negative temperature coefficient characteristic of the warning igniter allows the igniter to decrease in resistance value resulting in an increasing current which upon reaching a certain level opens the series connected valve. The valve and the igniter ideally are matched so that the valve opens when the igniter surface is sufficiently hot to ignite the fuel that is supplied upon opening the valve. Either of the above mentioned faults, that is a short circuit of the element, or an overtemperature of the igniter element, are neither detected nor prevented by such a simple arrangement and can be either dangerous or cause a costly failure of the ignition system.

SUMMARY OF THE INVENTION

The present invention is directed to a special series circuit arrangement using a negative temperature coefficient type of hot surface igniter that is connected through a fuel control valve, a fuse element and the secondary of a special regulating type of transformer. The transformer is designed so as to have a composite secondary voltage regulation characteristic which when combined with the igniter temperature-resistance characteristic: (a) allows the igniter temperature to reach ignition temperature and still open the valve at the lowest normal primary supply voltage (85%); (b) prevents overheating (due to excessive dissipation) of the igniter at the highest normal supply voltage (110%) by limiting the maximum possible dissipation and current in the igniter (and therefore also in the fuse); and (c) provides a (fuse) current, in the event of a shorted igniter, which is considerably greater at the 85% supply voltage than the maximum possible current at 110% when the igniter is not shorted (condition "b"). This latter condition is what makes the use of a fuse practical.

DESCRIPTION OF THE PREFERRED EMBODIMENT

Figure 1:
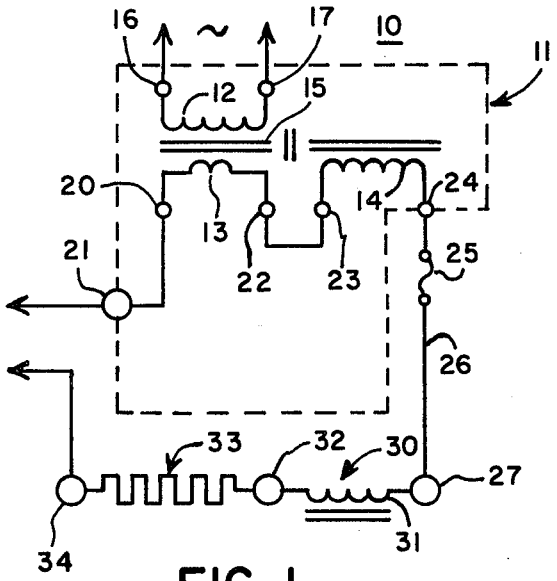
FIG. 1 is a schematic drawing of a complete system.

In FIG. 1 there is disclosed a hot surface fuel ignition system generally disclosed at 10. This system includes a special regulating transformer means 11 which includes a primary winding 12 and two secondary windings 13 and 14. The windins 12, 13 and 14 are magnetically coupled as shown at 15 and provide an unique voltage regulating characteristic that will be described in connection with FIG. 3. The physical structure of the regulating transformer means 11 will be described in connection with FIG. 2.

The winding 12 has a pair of terminals 16 and 17 that are adapted to be connected to a conventional source of alternating current electric energy. The winding 13 has a first end 20 connected to a terminal 21 and a second end 22 connected to a first end of the winding 14 at 23. The winding 14 has a terminal 24 that is in turn connected to a current interruption means 25 disclosed as an electrical fuse. The current interruption means or fuse 25 is connected by conductor 26 to a further terminal 27. The terminal 27 connects to one side of a fuel flow control means generally disclosed as 30 in the form of a solenoid winding 31 of a fuel valve. The fuel flow control means 30 has a further connection or terminal 32 that in turn is connected to a negative temperature coefficient hot surface igniter means generally disclosed at 33. The hot surface igniter means 33 can be of many different configurations and has been shown schematically as a resistor. This type of device can be manufactured out of a coil of negative temperature coefficient resistance wire, or can be manufactured of a solid formed material such as silicon carbide which has both a negative temperature coefficient of resistance and has the ability to withstand the temperatures present in normal fuel burning systems where gaseous type fuels are used. The exact design of the hot surface igniter means 33 is not material to the present invention. The igniter means 33 requires that it be a negative temperature coefficient resistance device which has the ability to have a surface temperature sufficient to ignite a fuel and which is capable of withstanding the normal heat in a flame, such as the main burner of a gas fired device.

The negative temperature coefficient hot surface igniter means 33 has a further terminal 34. The terminals 21 and 34 of the device disclosed in FIG. 1 are adapted to be connected to any type of control switch, not shown. The control switch could be a thermostat, a manually operated switch, if the device is used in a device such as a gas heater or gas range, or any other type of electrical control switch and is not material to the present invention. It should be understood that the voltage supplied by the secondary windings 13 and 14 of the regulating transformer means 11 is preferably of a relatively low voltage, and that the terminals 21 and 34, therefore can be connected directly to a low voltage circuit and thermostat. If the characteristics of the hot surface igniter means 33 are such that a higher voltage than the typical low voltage control level is required, this circuit can be designed for any convenient voltage level and the terminals 21 and 34 can be closed by a control switch such as a relay that in turn can be operated from a low voltage control circuit. The variations in the arrangement for the particular secondary voltage is not material to the present invention and is subject to well-known design techniques.

Figure 2:
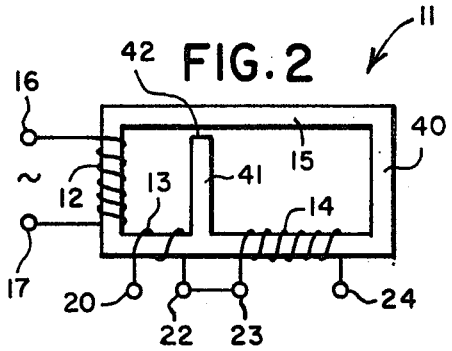
FIG. 2 is a representation of one form of the unique regulating transformer used in the present invention.

In FIG. 2, an example of the regulating transformer means 11 is disclosed having the magnetic core 15. The magnetic core 15 has a complete and continuous outer magnetic path 40, as well as a shunt magnetic path or leg 41 having an air gap 42 between the leg 41 and the balance of the magnetic path 40. The primary winding 12 is disclosed as encircling the outer magnetic circuit 40, while the first winding 13 also encircles that same portion of outer magnetic circuit 40 to the left of upstanding leg 41. The second secondary winding 14 encircles the outer magnetic circuit 14 to the right of the upstanding leg 41.

It will be understood that when alternating current power is applied to the primary winding 12 a magnetic flux is generated in the core 15 and that all of the magnetic flux that is generated by the winding 12 will link the secondary winding 13. The magnetic flux is then free to divide between the outer magnetic core 40 and the leg 41 depending on the amount of loading that is created by the secondary winding 14. As the secondary winding 14 becomes loaded, more and more of the magnetic flux in the core 15 is shunted through the leg 41 and across the air gap 42. With the arrangement thus disclosed, the winding 13 by itself has a rather flat voltage versus current wave form. The winding 14 taken by itself has a characteristic curve wherein the voltage drops very sharply as the loading or current in the winding 14 is increased.

Figure 3:
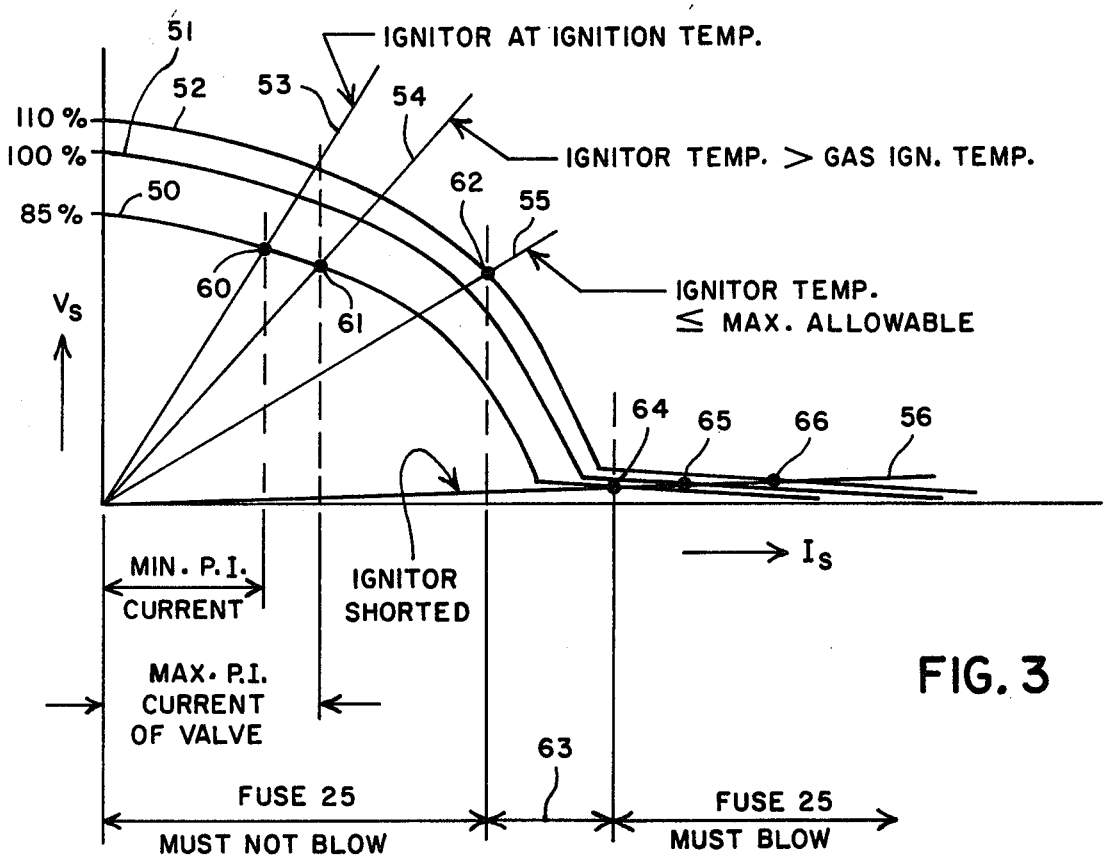
FIG. 3 is a secondary voltage versus current graph indicating the unique composite voltage versus current characteristics of the regulating transformer.

In the device disclosed in FIG. 1, the windings 13 and 14 are connected in series and, therefore, their voltage effects are directly additive providing a composite voltage characteristic curve that is disclosed in FIG. 3. This will be described in more detail in connection with FIG. 3.

In FIG. 3 a voltage versus current graph is presented. The total voltage of the secondary windings 13 and 14 are plotted versus the total secondary current. Three separate curves 50, 51 and 52 have been disclosed which represent the secondary voltage at 85% of rated, 100% of rated and 110% of rated supply voltage applied at terminals 16 and 17. The range of 85% of rated voltage on curve 50 to 110% of rated voltage on curve 52 are the normal operating extremes for the control system. Also plotted on the graph disclosed in FIG. 3 are four load lines for the igniter means 33 at four different temperatures or conditions of conductivity. The first load line 53 is when the igniter means 33 has just reached a temperature at which reliable and safe ignition of the fuel is possible. The load line 54 is a typical load line for the igniter means 33 being at an igniter temperature which is greater than the temperature necessary to ignite the fuel. The load line 55 is a load line for the hot surface igniter means 33 when the igniter means is at the maximum temperature at which the system allows it to operate. This limit is designed in to assure a long life of the igniter means 33. A final load line 56 is disclosed representative of the igniter means 33 being short circuited due to some failure.

When the voltage versus current graph 50 at 85% of rated voltage is considered along with the load line 53, an intersection 60 is of significance. The intersection 60 is at the minimum secondary current for safe operation of the system disclosed in FIG. 3 and illustrates the minimum amount of current that is drawn with the igniter means 33 at the minimum temperature for safe ignition of the fuel for the system. It will be noted that any point along the load line 53 at a higher secondary voltage yields a larger secondary current. The intersection 60 has been selected along with the fuel flow control means 30 so that the fuel flow control means 30 always opens at a current corresponding to the intersection at 60 or at any higher secondary current level. It is thus apparent that if the voltage is above the 85% level and if the load line 53 has been reached, that a current sufficient to open the fuel flow control means 30 is provided, while at the same time assuring that the igniter is at ignition temperature.

A further intersection 61 is disclosed between the load line 54 and the 85% secondary voltage. The intersection 61 represents the maximum pull-in current that should be necessary to activate the fuel flow control means for reasons of system practicality.

A third intersection point 62 has been noted. Intersection point 62 is the critical intersection of the load line 55 at which time the igniter means 33 is at its maximum allowed temperature which occurs when the secondary voltage is at 110% of the rated voltage. The intersection point 62 is the maximum current which would normally be expected to be drawn in the system disclosed in FIG. 1 and the fuse or current interruption means 25 is selected so that it will not operate. The current interruption means or fuse 25 must carry the current indicated at the point 62 as this is the maximum normal operating current for the system.

It will be noted that if a load line occurs between the load lines 55 and 56 that a current larger than the maximum current to be carried by the current interruption means 25 is carried. With the curves disclosed, which are typical curves as opposed to theoretically ideal curves, there is a short region 63 of the secondary current that is a safety region underlap. Since in a practical system all of the components cannot be manufactured uniformly, a slight underlap 63 between the maximum current that the current interruption means or fuse 25 must carry and that which will cause it to operate are provided.

The next point of operation to be considered is when the igniter means 33 is short circuited. For this case the load line 56 applies. The three curves 50, 51 and 52 intersect the load line 56 at 64, 65 and 66. The intersection at point 64 has been selected as a point at which the secondary current has reached a level that is considered unsafe and the current interruption means or fuse 25 must operate to interrupt the current flow to the igniter and fuel flow control means 30 whenever the current reaches the value represented by the intersection 64. It will be noted that the intersection 65 and 66 along the load line 56 are all higher than point 64 which is at the 85% rated voltage. It is thus apparent that the secondary current at 65 and 66 is even higher than that at 64 and, therefore, would cause the current interruption means or fuse 25 to operate also.

With the arrangement disclosed, a system has been provided which will not allow the fuel flow control means or valve 30 to operate until the igniter means 33 is at least hot enough to ignite fuel in the normal voltage operating range for the system, and which will further be deactivated by the operation of the current interruption means or fuse 25 should the igniter reach an excessively high temperature or be short circuited. The amount of the safety region underlap 63 can be designed as wide or narrow as deemed necessary. The narrower the safety region underlap 63 becomes, the more critical the selection and design of the various components in the system become.

Figure 4:
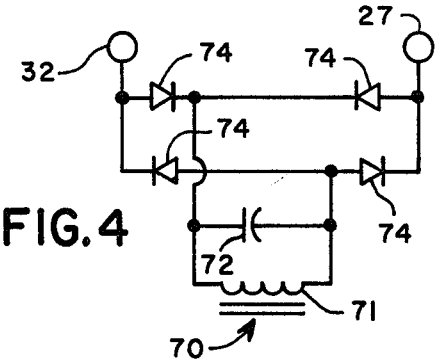
FIG. 4 is an alternate valve connection adapted to be used with the circuit of FIG. 1.

In FIG. 4 there is disclosed a direct current operated fuel flow control means 70 which includes a solenoid 71 and a storage capacitor 72 that is fed from a diode bridge including diodes 74 to provide a full wave rectifier to charge the capacitor 72 to thus provide the necessary energy to operate the fuel control means 70. A pair of terminals 32 and 27 are provided and the fuel flow control means 70 disclosed in FIG. 4 can be substituted for the fuel flow control means 30 of FIG. 1, if desired.

In the hot surface fuel igniter system disclosed, the use of a special regulating transformer means having a characteristic curve which is relatively flat in the normal operating range and which drops off sharply when the fuel ignition means 33 is either overheated or shorted has been disclosed. With this type of arrangement, the current drawn in the series arrangement of the fuel ignition means 33, the fuel flow control means 30, and the current interruption means 25 can be utilized to both provide a minimum pull in or operating point for the system, and an overload safety which will disconnect the system by the operation of the current interruption means 25 in the event of an overtemperature of the ignition means 33 or its short circuiting. The arrangement disclosed can be altered by the design of other types of regulating transformer means that provide this same general type of voltage versus current characteristics and the selection of the components to utilize the particular characteristic curves. The invention disclosed in the FIGS. 1 through 4 have been illustrative only and the scope of the present invention is determined solely by the scope of the appended claims.

The embodiments of the invention in which an exclusive property or right is claimed are defined as follows:

1. A hot surface fuel ignition system, including: hot surface igniter means having a negative temperature coefficient of resistance and a surface that reaches a temperature high enough to ignite a fuel when said igniter means conducts a predetermained electric current; fuel flow control means operated to an open position when carrying said electric current; current interruption means capable of continuous current conduction at said predetermined electric current level, but which open circuits when carrying a current higher than said predetermined electric current; regulating transformer means having a primary circuit adapted to be energized from a source of electric power and secondary circuit means; and said secondary circuit means connected in a series circuit with said igniter means, said fuel flow control means, and said current interruption means with said series circuit adapted to be completed by a control switch; said regulating transformer means supplying said predetermined electric current in said series circuit as long as the resistance of said igniter means is such as to cause said igniter means to be hot enough to ignite said fuel; said regulating transformer means supplying a current higher than said predetermined electric current upon said ignition means reaching a sufficiently low resistance to thereby cause said current interruption means to operate and deenergize said fuel flow control means.

2. A hot surface fuel ignition system as described in claim 1 wherein said regulating transformer means includes a magnetic core with two magnetic flux paths and a magnetic flux generated within said core by a current in said primary circuit; said secondary circuit means having two electrical windings magnetically coupled by said core; a first of said windings in a first flux path linked by substantially all of said flux; and a second of said windings in a second flux path linked by a portion of said flux when said igniter means conducts said predetermined electric current.

3. A hot surface fuel ignition system as described in claim 2 wherein one of said magnetic flux paths includes an air gap.

4. A hot surface fuel ignition system as described in claim 3 wherein said fuel flow control means is solenoid operated valve means.

5. A hot surface fuel ignition system as described in claim 4 wherein said current interruption means is a self-heating fusible element.

6. A hot surface fuel ignition system as described in claim 5 wherein said self-heating fusible element is an electrical fuse.

7. A hot surface fuel ignition system as described in claim 6 wherein said valve means includes rectifier means to provide an unidirectional current for operation of said valve means.

8. A hot surface fuel ignition system as described in claim 6 wherein said hot surface igniter means is a silicon carbide igniter.

9. A hot surface fuel ignition system as described in claim 7 wherein said hot surface igniter means is a silicon carbide igniter.

10. A hot surface fuel ignition system as described in claim 3 wherein said magnetic flux generated within said core changes abruptly upon said igniter means reaching said sufficiently low resistance to thereby cause a sharp increase in a current in said secondary circuit means to activate said interruption means to cause said fuel flow control means to immediately close to turn off fuel in said system.

* * * * *